US006327805B1

(12) United States Patent
Clifton, Jr.

(10) Patent No.: US 6,327,805 B1
(45) Date of Patent: Dec. 11, 2001

(54) DOUBLE MAGAZINE CLAMPING DEVICE

(76) Inventor: Norman E. Clifton, Jr., 607 Trumpet Vine Ct., Jacksonville, FL (US) 32225

( * ) Notice: Subject to any disclaimer, the term of this patent is extended or adjusted under 35 U.S.C. 154(b) by 0 days.

(21) Appl. No.: 09/539,742

(22) Filed: Mar. 31, 2000

(51) Int. Cl.[7] ..... F41A 9/68
(52) U.S. Cl. ..... 42/90; 42/90; 42/50; 42/49.01
(58) Field of Search ..... 42/90, 50, 49.01

(56) References Cited

U.S. PATENT DOCUMENTS

| | | | | |
|---|---|---|---|---|
| 4,115,943 | * | 9/1978 | Musgrave | 42/90 |
| 4,484,404 | * | 11/1984 | Johnson | 42/90 |
| 5,279,059 | * | 1/1994 | Howard | 42/90 |
| 5,636,465 | * | 6/1997 | Johnson | 42/90 |

* cited by examiner

*Primary Examiner*—Michael J. Carone
*Assistant Examiner*—Lulit Semunegus
(74) *Attorney, Agent, or Firm*—Arthur G. Yeager

(57) ABSTRACT

A securing device for holding two ammunition magazines in a manner to allow one and then the other magazine to be loaded into a firearm includes two brackets for engaging the upper and lower surface of both magazines and holding them side-by-side. The brackets are connected together with a screw threadably engaged into the lower bracket and threadably engaged with an overcenter toggle lever on top of the other bracket. The toggle lever is operable to lock the brackets in place. A flexible strap is mounted to the upper bracket and connectable to the lower bracket in a manner to partially encircle the magazine located on each side of the brackets. The flexible strap is used for continuous length adjustment to accommodate magazines having a wide variety of sizes and shapes. The brackets are sized to space the magazines to allow one to be loaded in a firearm without interference from the other magazine.

20 Claims, 2 Drawing Sheets

DOUBLE MAGAZINE CLAMPING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to devices for securing one or more ammunition magazines or clips together.

2. Related Art

There are a wide variety of devices used for securing ammunition magazines together. A typical device employs metal brackets that are spring-biased and may have a lever or other device to open or close the bracket. The brackets are fixed in size and shape thus requiring multiple devices if many firearms are to be used. Improvements are needed to allow one device to be used with a wide variety of clips.

BRIEF SUMMARY OF THE INVENTION

In one aspect of the present invention there is provided a securing device for removably carrying two magazines for ready use with a firearm comprising first and second spaced brackets for engaging a pair of magazines to position same spaced apart and side-by-side. A first adjustable securing means is connected between the brackets for selectively adjusting the distance between the brackets and a second adjustable securing means is connectable between the brackets for partially encircling an exterior surface of each magazine to secure each magazine against the brackets, the second adjustable securing means being continuously adjustable in length.

In other aspects of the invention the first bracket includes a body having opposite sides and a pair of flanges extending outwardly from respective magazine mounted against a corresponding side, the body being sized to space magazines mountable to respective sides apart to allow a magazine to be inserted for use into a firearm when both magazines are being carried by the device. The first adjustable securing means includes locking means for locking the first adjustable securing means at a selected distance between the brackets. The first adjustable securing means includes an elongated member secured to one bracket and passing through another bracket, the locking means including an overcenter toggle lever attached to the elongated member for engaging a surface of the another bracket. The second adjustable securing means includes at least one flexible strap.

The second adjustable securing means includes at least one strap formed of flexible material to enable the strap to generally conform to an exterior shape of a magazine. The strap has a center portion and two opposite end portions, the strap extending from the center portion to one end portion of the strap for securing one magazine, the strap extending from the center portion to another end portion of the strap for securing another magazine. The center portion of the strap is fixedly secured to the first bracket and the end portions are adjustably secured to the second bracket. The first adjustable securing means includes a bolt having opposite end portions, one end portion being threadably engaged with the second bracket.

In other aspects of the present invention there is provided a securing device for removably carrying two magazines for use with a firearm comprising a first upper and a second lower bracket each having opposite sides for engaging each magazine to position same respectively on one side of the brackets and another side of the brackets. A first adjustable securing means is connected between the brackets for selectively adjusting the distance between the brackets for selectively adjusting the distance between the brackets and second adjustable securing means is connected to and between the brackets for partially encircling exterior surfaces of magazines to secure same against the sides of the brackets, the second adjustable securing means being adjustable in length. The first bracket includes a body being sized to space magazines mounted to respective sides of the brackets a sufficient distance apart to allow one magazine to be inserted into a firearm when both magazines are being carried by the device. A locking means is included and employs an overcenter toggle lever for engaging a surface of the first bracket. The second adjustable securing means includes a flexible strap having a center portion and two opposite end portions, one magazine being partially encircled by a length of the strap extending from the center portion to one end portion of the strap, another magazine being partially encircled by a length of the strap extending from the center portion to another end portion of the strap. The center portion of the strap is fixedly secured to the first bracket and the end portions are adjustably secured to the second bracket.

Additional aspects of the invention include a securing device for removably carrying two magazines for ready use with a firearm comprising a pair of magazines, first and second space brackets for engaging a pair of magazines to position the magazines spaced apart and side-by-side, first adjustable securing means connected between the brackets for selectively adjusting the distance between the brackets, second adjustable securing means connectable between the brackets for partially encircling an exterior surface of each magazine to secure each magazine against the brackets, the second adjustable securing means being adjustable in length. The strap has a center portion and two opposite end portions, one magazine being secured by a length of the strap extending from the center portion to one end portion of the strap, another magazine being secured by a length of the strap extending from the center portion to another end portion of the strap.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
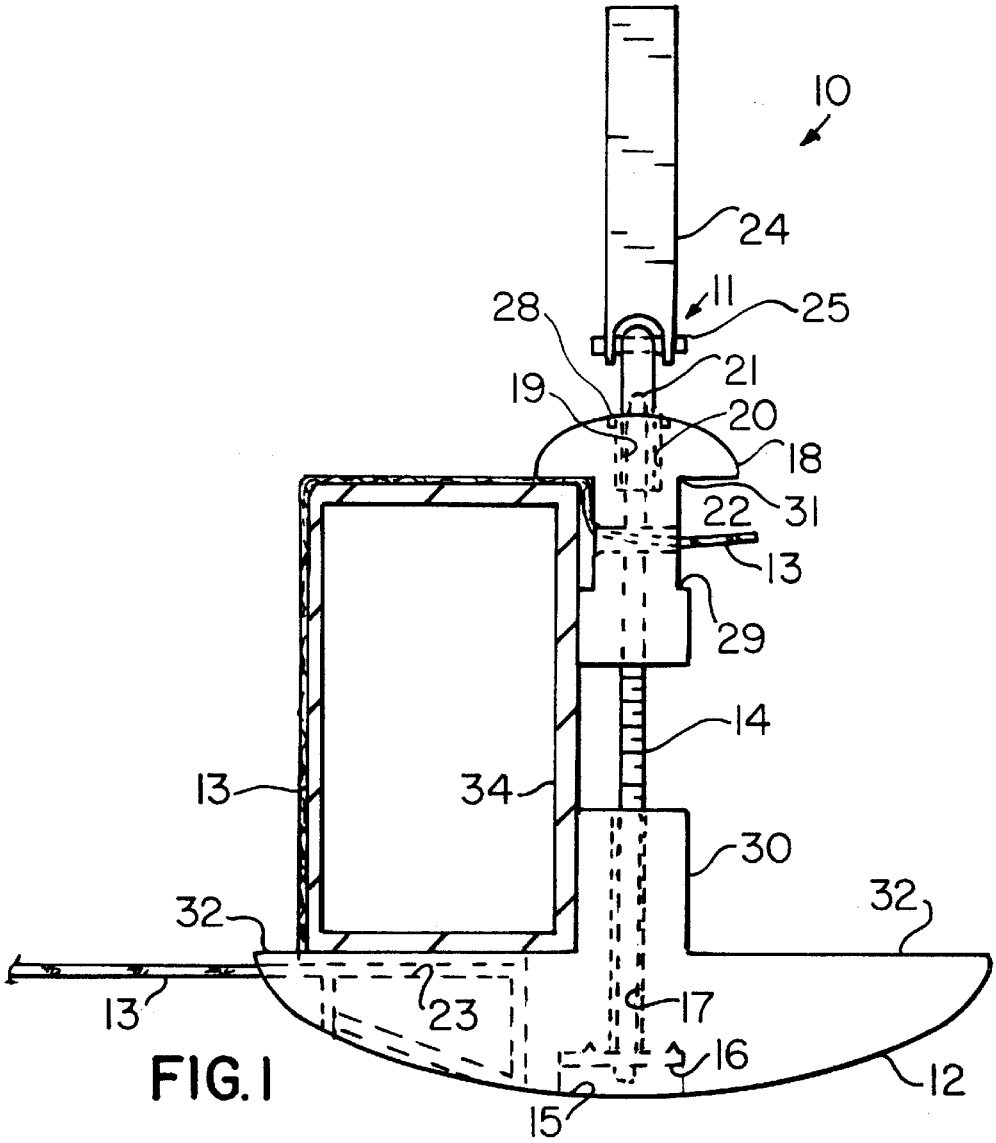
FIG. 1 is an elevational view of a double magazine clamping device in accord with the present invention.

With respect now to the drawings, the double magazine clamping device is shown at 10 in FIG. 1. Locking apparatus 11 includes a pivot-mounted "overcenter toggle" that engages locking bracket 18 (FIG. 2) as will be discussed hereinbelow.

Strap bracket 12 has a passageway 22 through which a strap 13 is passed. The securing screw 14 passes through strap 13 thus securing both ends of the strap 13 at its center. Bolt 14 fits through passageway 17 in bracket 12 and is threaded into a fixed T-nut 16 that is mounted in recess 15.

Passageway 19 extends through bracket 18 to provide for bolt 14. Another larger passageway 20 provides space for locking post 21 that is pivotally mounted to locking lever 24 via pin 25 at one end the other end of post 21 threadably engages one end of bolt 14. Rotation of lever 24 provides for vertical adjustment of the lever 24 as will be discussed hereinbelow.

Figure 3:
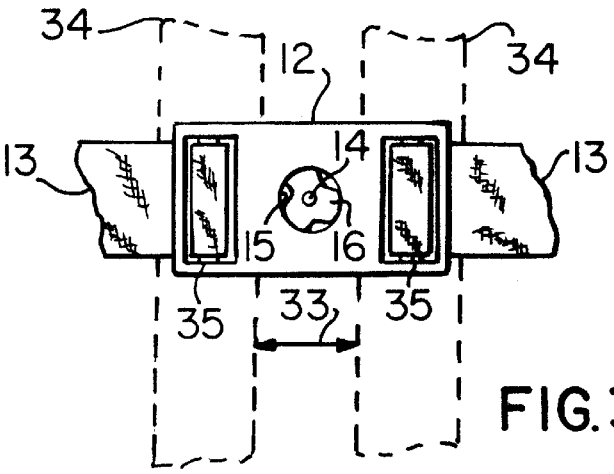
FIG. 3 is a partial bottom view of the lower bracket of the device of FIG. 1.

The position of a magazine 34 (shown in cross-section) is defined by strap 13 and the two brackets 12 and 18. Strap 13 extends from the point at which mounted on screw 14 outwardly into vertical undercut recess 29 and over the top of magazine 34. The strap 13 is pulled securely against the side of magazine 34 downwardly under it via under channel 23. This arrangement provides a firm seating surface on flange 32 for magazine 34. The strap 13 is then threaded through the bracket 12 that is formed as a buckle (FIG. 3). The width of bracket post 30 defines the spacing between two magazines 34 with the cooperation of the lower portion of bracket 18 at flange 31.

Figure 2:
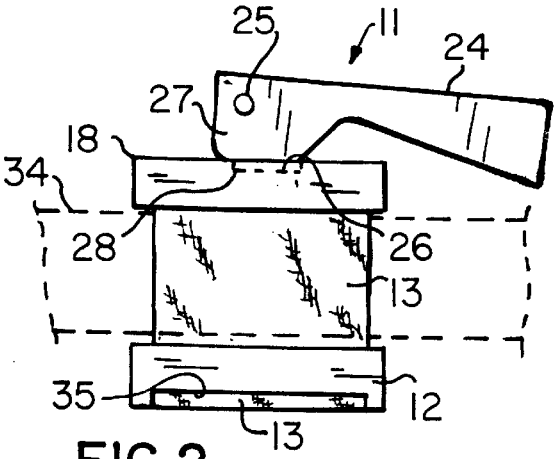
FIG. 2 is an enlarged side view of the locking apparatus of the device of FIG. 1.

FIG. 2 illustrates the overcenter toggle 11 in the down or locked position. Recess 26 carries a metal engaging ring 28 that engages the head portion 27 of lever 24 when moved down at pivot pin 25. The downward force applied is adjusted by rotating lever 24 when it is in the up or unlocked position illustrated in FIG. 1.

FIG. 3 illustrates a bottom view of the device of FIG. 1. Bracket 12 has two buckle slots 35. Spacing arrow 33 illustrates the separation of the two magazines 34 a sufficient distance to prevent interference between the magazine 34 being used and the other magazine not currently installed in a firearm (not shown).

Figure 4:
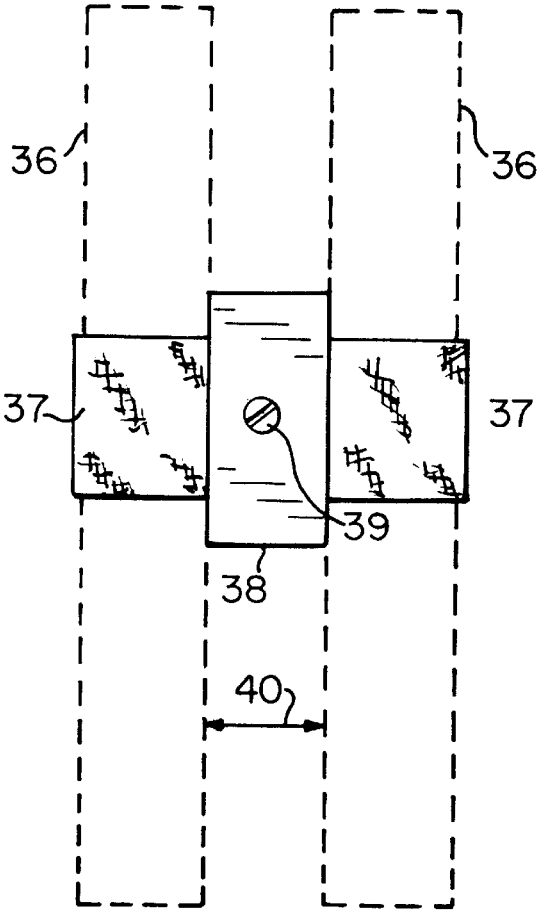
FIG. 4 is a top view of an alternative clamping device in accord with the present invention.

FIG. 4 illustrates an alternate embodiment of the clamping device. Top bracket 38 includes a bolt head 39 which is used to tighten the apparatus in lieu of the locking apparatus 11 illustrated in FIGS. 1–3 straps 37 may be wider in this embodiment that is used for securing magazines 36 that are substantially larger than magazines 34. The bottom bracket is the same as bracket 12 but larger in size.

Figure 5:
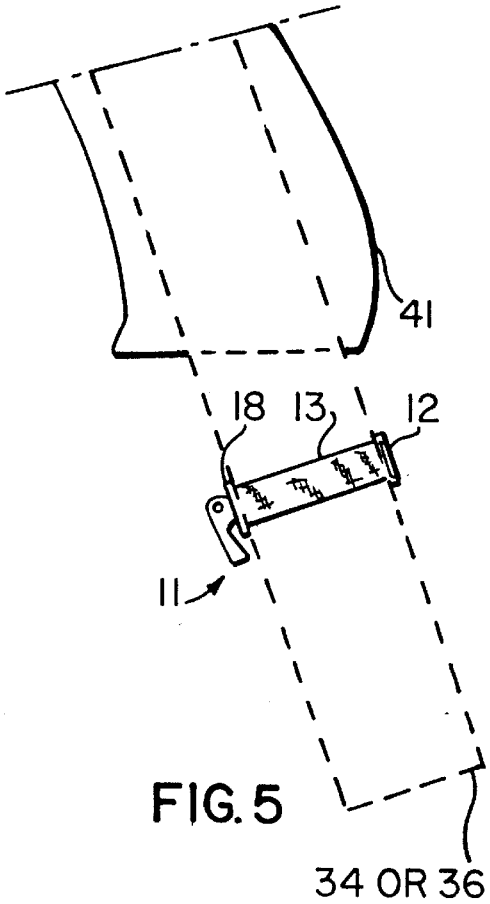
FIG. 5 is a pictorial side view of the clamping device of FIGS. 1–3 showing the relative position of the clamped magazines when in use with a firearm.

The width of the space 33 and the space 40 is sized to provide that one magazine can be inserted in a firearm 41 (FIG. 5) with the other magazine spaced away from the outside wall of the magazine well and the outside wall of the firearm hand grip if the hand grip is about the magazine well.

The use of straps 13 and 37 allow for continuous adjustment and a tight secure fit with any magazine size or shape. In addition, the use of elongate bolts such as 14 also allows for various magazine sizes. Finally, in practice the extra length of ends of straps 13 and 37 are cut off once the device is secured to the magazines 34 and 36 being used.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A securing device for removably carrying two magazines for ready use with a firearm comprising first and second spaced brackets for engaging a pair of magazines to position same spaced apart and side-by-side, first adjustable securing means connected between said brackets for selectively adjusting the distance between said brackets, second adjustable securing means connectable between said brackets for partially encircling an exterior surface of each magazine to secure each magazine against said brackets, said second adjustable securing means being continuously adjustable in length to accommodate various magazine sizes.

2. The device as defined in claim 1 wherein said first bracket includes a body having opposite sides and a pair of flanges extending outwardly from respective said sides for engaging a top surface of a respective magazine mounted against a corresponding said side, said body being sized to space magazines mountable to respective said sides apart to allow a magazine to be inserted for use into a firearm when both magazines are being carried by said device.

3. The device as defined in claim 1 wherein said first adjustable securing means includes locking means for locking said first adjustable securing means at a selected distance between said brackets.

4. The device as defined in claim 3 wherein said first adjustable securing means includes an elongated member secured to one said bracket and passing through another said bracket, said locking means including an overcenter toggle lever attached to said elongated member for engaging a surface of said another said bracket.

5. The device as defined in claim 1 wherein said second adjustable securing means includes at least one flexible strap.

6. The device as defined in claim 1 wherein said second adjustable securing means includes at least one strap formed of flexible material to enable said strap to generally conform to an exterior shape of a magazine.

7. The device as defined in claim 6 wherein said strap has a center portion and two opposite end portions, said strap extending from said center portion to one said end portion of said strap for securing one magazine, said strap extending from said center portion to another said end portion of said strap for securing another magazine.

8. The device as defined in claim 7 wherein said center portion of said strap is fixedly secured to said first bracket and said end portions are adjustably secured to said second bracket.

9. The device as defined in claim 1 wherein said first adjustable securing means includes a bolt having opposite end portions, one end portion being threadably engaged with said second bracket.

10. A securing device for removably carrying two magazines for use with a firearm comprising a first upper and a second lower bracket each having opposite sides for engaging each magazine to position same respectively on one said side of said brackets and another said side of said brackets, first adjustable securing means connected between said brackets for selectively adjusting the distance between said brackets, second adjustable securing means connected to and between said brackets for partially encircling exterior surfaces of magazines to secure same against said sides of said brackets, said second adjustable securing means being adjustable in length to accommodate various sizes of said magazines.

11. The device as defined in claim 10 wherein said first bracket includes a body, said body being sized to space magazines mounted to respective said sides of said brackets a sufficient distance apart to allow one magazine to be inserted into a firearm when both magazines are being carried by said device.

12. The device as defined in claim 10 wherein said first adjustable securing means includes locking means for locking said first adjustable securing means at a selected distance between said brackets.

13. The device as defined in claim 12 wherein said first adjustable securing means includes a screw having opposite end portions, one end portion being threadably engaged to said second bracket another said end portion threadably engaged to said locking means.

14. The device as defined in claim 12 wherein said locking means includes an overcenter toggle lever for engaging a surface of said first bracket.

15. The device as defined in claim 14 wherein said second adjustable securing means includes a flexible strap.

16. The device as defined in claim 14 wherein said second adjustable securing means includes a strap formed of flexible material to enable said strap to conform to an exterior shape of a magazine when a magazine is partially encircled with said strap.

17. The device as defined in claim 16 wherein said strap has a center portion and two opposite end portions, one magazine being partially encircled by a length of said strap extending from said center portion to one said end portion of said strap, another magazine being partially encircled by a length of said strap extending from said center portion to another said end portion of said strap.

18. The device as defined in claim 17 wherein said center portion of said strap is fixedly secured to said first bracket and said end portions are adjustably secured to said second bracket.

19. A securing devices for removably carrying two magazines for ready use with a firearm comprising a pair of magazines, first and second spaced brackets for engaging a said pair of magazines to position said magazines spaced apart and side-by-side, first adjustable securing means connected between said brackets for selectively adjusting the distance between said brackets, second adjustable securing means connectable between said brackets for partially encircling an exterior surface of each said magazine to secure each said magazine against said brackets, said second adjustable securing means being adjustable in length to accommodate various sizes of said magazines.

20. The securing device as defined in claim 19 wherein said second adjustable securing means includes a strap having a center portion and two opposite end portions, one said magazine being secured by a length of said strap extending from said center portion to one said end portion of said strap, another said magazine being secured by a length of said strap extending from said center portion to another said end portion of said strap.

* * * * *